United States Patent [19]

Woodings

[11] Patent Number: 5,020,780

[45] Date of Patent: Jun. 4, 1991

[54] QUICK CONNECT-DISCONNECT COUPLING FOR BLAST FURNACE TAP HOLE DRILL BIT

[75] Inventor: Robert T. Woodings, Pittsburgh, Pa.

[73] Assignee: Woodings Industrial Corporation, Mars, Pa.

[21] Appl. No.: 504,434

[22] Filed: Apr. 4, 1990

[51] Int. Cl.[5] ..... C21C 5/48

[52] U.S. Cl. ..... 266/271; 408/226

[58] Field of Search ..... 266/45, 271, 287; 408/226

[56] References Cited

U.S. PATENT DOCUMENTS

| | | | |
|---|---|---|---|
| 3,618,926 | 11/1971 | Bernat | 266/271 |
| 4,273,202 | 6/1981 | Phillips et al. | 266/271 |
| 4,293,253 | 10/1981 | Ott | 408/226 |

*Primary Examiner*—S. Kastler

*Attorney, Agent, or Firm*—Waldron & Associates

[57] ABSTRACT

The component parts of a drill rod assembly on a blast furnace tap hole drill are joined together by providing a coupling having at least one extension with frusto-conical side walls adapted to mate with a socket having frusto-conical side walls within the drill rod component to be connected thereto, or in the alternative, incorporating such a coupling as a portion of one of the component parts.

26 Claims, 2 Drawing Sheets

QUICK CONNECT-DISCONNECT COUPLING FOR BLAST FURNACE TAP HOLE DRILL BIT

BACKGROUND OF THE INVENTION

1. Field of the Invention

The present invention relates to the art of opening blast furnace tap holes and to blast furnace tap hole drills, and more particularly to unique quick connect-disconnect coupling which can be utilized within the drill rod assembly which will not only permit a quick connection and disconnection of the drill rod components, but will also prolong the useful life of the components connected thereto.

2. Summary of the Prior Art

It is well known that the hearth of an iron blast furnace is provided with a tap hole, commonly referred to as a "iron notch", through which molten iron, usually referred to as "hot metal", is drawn off at periodic intervals during the blast furnace campaign. During a normal campaign, such tapping must be done on an average of five to twelve times daily, as the blast furnace hearth becomes filled with molten iron and slag. After the blast furnace has been tapped, i.e. the molten hot metal and slag drained therefrom, the tap hole or iron notch is plugged with clay or "mud" which will harden and seal the tap hole until the next time the blast furnace is tapped.

In accordance with usual practices, a special drill is utilized to open a tap hole, i.e. drill a passageway through the hardened clay plugging the iron notch, for the purposes of tapping the blast furnace. Such blast furnace tap hole drills are normally pneumatically or hydraulically operated rotary percussion drills comparable to the rock drills utilized in the mining industry. Such drills impart both a rotary and an impact force on an elongated drill rod having a rock drill bit at the end towards the iron notch.

The base support for the blast furnace tap hole drill is normally secured to the floor, a structural column or some solid base structure, and is provided with suitable linkage members and remote controls so that the blast furnace tap hole drill can be remotely operated to move the drill into the proper position for drilling the tap hole, then operated to drill the tap hole, and thereafter, moved back away from the tap hole and heat of the emerging hot metal, where the drill can be serviced and prepared for the next tap.

To prepare the blast furnace tap hole drill for each succeeding tap, it is always necessary to replace the drill bit, if not the drill rod or a portion thereof. This is because the temperature of the blast furnace hot metal, being about 2700–2800° F., severely erodes the drill bit after it drills through the clay plug and enters the bath of molten not metal. In addition, once the tap hole is drilled, the ferrostatic head of hot metal within the blast furnace will cause the hot metal to emerge through the tap hole around the drill bit and drill rod before the drill rod and bit can be withdrawn from the tap hole. Often times, the drill bit will not only be severely eroded but the portion remaining will virtually be "welded" to the end of the drill rod to which it had previously been removably attached. In such an event, it will be impossible to remove the drill bit from the drill rod to replace a new drill bit, and accordingly it then becomes necessary to replace the entire drill bit and adjoining drill rod or drill rod component to which it is welded.

To reduce the expense of replacing the entire drill rod and bit assembly, it has become common practice to utilize a drill rod extension, which is merely a removable end portion of the drill rod, typically from 18 to 30 inches in length, fitted between the elongated rearward portion of the drill rod and the drill bit. Therefore, when the drill bit becomes welded to the drill rod extension bar, or the extension bar otherwise damaged, the bit and extension bar can be replaced without the need for replacing the entire drill rod assembly. In utilizing this technique, it still at times happens that the outward pouring of hot metal around the extension bar will cause severe erosion at the interface between the drill rod and extension, often times welding the extension bar and coupling to the drill rod. In such an event, it will still be necessary to replace the entire drill rod assembly. Even though the drill rod, extension bar and coupling are usually provided with a protective ceramic coating, the hot metal often attacks, erodes and welds the uncoated contacting interfaces between the coupling and extension bar or drill rod, just as it attacks the interface between the drill bit and extension bar.

While it is of course possible to remove the drill bit from the drill rod extension bar or the extension bar from the drill rod with an acetylene cutting torch, use of this procedure will usually damage the threaded ends of the extension bar or drill rod so severely that they cannot be reused anyway, so that nothing useful can be salvaged by using this technique.

While in some situations it may be possible to remove one drill rod component from another, such as a drill bit from an extension bar, it often happens that the threaded portion of the extension bar is not reusable. This is because the threaded portions of the drill bit and extension bar are perhaps the most vulnerable surfaces to damage.

SUMMARY OF THE INVENTION

This invention is predicated upon the conception and development of a unique connection or coupling for attaching the drill bit to an extension bar or a drill rod, which is not based on machine threaded interconnections, but rather a tapered, frusto-conical interconnection. This unique new interconnection will not only provide a quick connect and disconnect feature to the joining of component parts, but will also provide an interconnecting surface which is significantly less vulnerable to damage by the blast furnace hot metal, thereby significantly enhancing the average useful life of any extension bar or drill rod having such a connection. Accordingly, this inventive connection will render the components more quickly and easily attachable to each other, as well as more quickly and easily removable from each other after the tap hole has been drilled, thereby significantly extending the average useful life of drill rods and extension bars. The unique coupling may be either an independent coupling device adapted to fit between two component parts of the drill rod assembly, or may be incorporated into the component parts themselves so that a separate coupling device is not required.

DETAILED DESCRIPTION OF THE INVENTION

Figure 1:
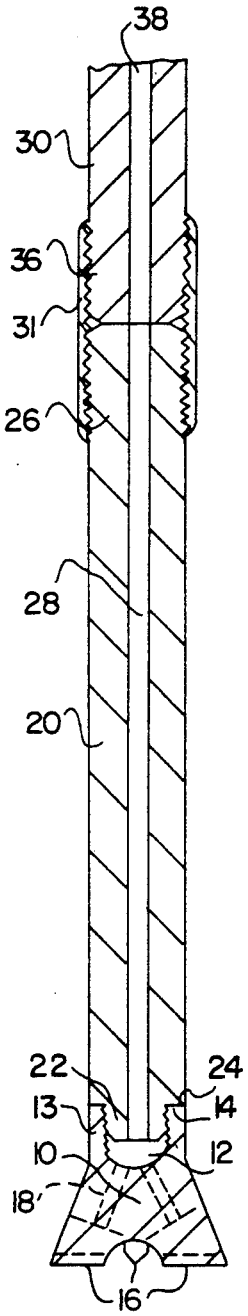
FIG. 1 (PRIOR ART)
FIG. 1 is a cross-sectional side view illustrating a typical drill rod assembly as utilized in the prior art, showing the connections between the drill bit and extension bar, and between the extension bar and the drill rod.

Reference to FIG. 1 will illustrate the prior art technique for interconnecting the drill rod assembly wherein a drill bit 10 is connected to an extension bar 20, and extension bar 20 is connected to a drill rod 30. While it is recognized that the drill bit 10 can be directly attached to the drill rod 30, without utilizing a removable extension bar 20, such practice has become rather rare. For purposes of simplifying the following discussion therefore, the attachment of the drill bit will be discussed with reference only to its being attached to the extension bar, with the understanding that the drill bit can, if so desired, be attached directly to the drill rod without utilizing an extension bar.

As can be seen in FIG. 1, one end of the extension bar 20 is provided with a threaded extension head portion 22 which mates with the threaded pilot hole 12 in the shank 13 of drill bit 10. The threaded portion of pilot hole 12 is deeper than the length of threaded head portion 22, so that the annular edge rim 14 on shank 13 will tighten against shoulder 24 on extension bar 20 to tightly secure drill bit 10 onto extension bar 20.

To secure extension bar 20 to drill rod 30, the customary practice has been to machine threads into the adjoining ends thereof 26 and 36 respectively, and join the together with a conventional tubular coupling 31.

As can further be seen from FIG. 1, the drill rod 30 and extension bar 20 are each provided with a port 38 and 28 respectively through their axis for the purpose of injecting air during the drilling operation. This injected air passes through ports 18 in the drill bit 10 which emerges between the cutting tips 16 of drill bit 10 to purge drilling debris from the drilling site.

While the entire surface of drill bit 10 will be eroded when it comes into contact with the molten hot metal within the blast furnace, the ferrostatic head of hot metal within the furnace will cause the hot metal to emerge from the furnace and move along the periphery of the extension bar 20, if not also the drill rod 30, as previously noted. For this reason, it is customary practice to coat the outer surfaces of the extension and drill rods 20 and 30 with a flame sprayed ceramic coating to protect them from being melted and eroded during that brief period of time before the drill rod assembly can be withdrawn from the tap hole. Although the extension bar 20 and drill rod 30 are somewhat protected by the ceramic coating, it is not uncommon for the hot metal to attack the uncoated interfaces between the component parts, melting and washing out metal at the interfaces between annular rim 14 and shoulder 24, as well as the threaded interface between coupling 31 and extension bar 20 and drill rod 30. Not only is the metal melted and washed from these interfaces, but often times the adjoining components are caused to be welded together at these sites as above discussed.

Even if the adjoining components are not welded together, it very often happens, particularly at the interconnection between the drill bit 10 and extension bar 20, that the threaded surface of head 22 will be so severely eroded or damaged, that it cannot be reused. Even when the threaded interface is not melted by the hot metal, the heat to which it is exposed, in combination with the stresses on the threads, may virtually strip the threads from head 22, thereby rendering extension bar 20 useless and therefore requiring replacement.

Figure 2:
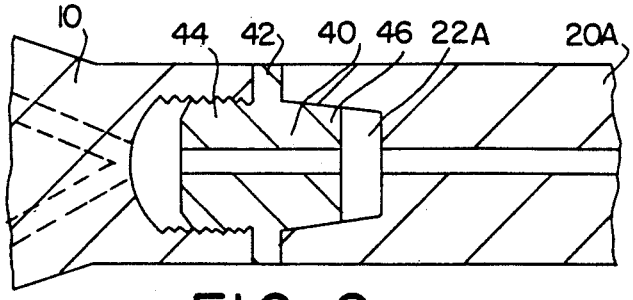
FIG. 2 is an cross-sectional side view illustrating a connection between a conventional drill bit and extension bar according to one embodiment of this invention.

Reference to FIG. 2 will illustrate one embodiment of this invention wherein a coupling according to this invention is interposed between a conventional drill bit 10 and drill rod 20A. As shown, the coupling 40 comprises a body portion which may consist merely of circular flange 42 at its approximate midpoint, with a threaded head portion 44 extending in one direction from the center of flange 42 and adapted to engage and retain drill bit 10. A frusto conical extension 46 is provided and centered on the other side of flange 42 for engaging and retaining extension bar 20A.

Extension bar 20A must be slightly modified from the extension bar shown in FIG. 1 in that it must have a frusto-conical socket 22A in its forward surface having dimensions that will mate with frusto-conical extension 46 on coupling 40. The frusto-conical surfaces of extension 46 and socket 22A must of course be the same, and should be within the range of from 3 to 12 degrees with the axis of the drill rod assembly. Specifically, the angle must be at least 3 degrees to assure that extension 46 can be easily and fully inserted within socket 22A, and should be no greater that 12 degrees to assure that when fully inserted, there will be sufficient binding fiction at the frusto-conical interface to tightly secure the two components together with a modest tapping action. The depth of socket 22A should be greater that the length of extension 46 to assure that extension 46 does not abut the base of socket 22A and prevent the essential tight binding of the frusto-conical interfaces.

As should be readily apparent, coupling 40 can be twisted onto drill bit 10 and tightly secured thereto, and thereafter, the drill bit coupling combination can be attached to extension bar by merely inserting extension 46 fully into socket 22B and moderately tapping them together so that coupling 40 will be tightened onto extension bar 20A. Because the drilling action of the tap hole drill is impact as well as rotary, there will be little likelihood that the connection will become loosened during the drilling operation. Indeed, the drilling operation will function to tighten or assure a tight binding fit between the extension bar 20A and coupling 40.

When the drilling operation is completed and the drill rod assembly withdrawn from the tap hole, the drill bit will of course be severely melted away and in need of replacement. A few sharp lateral blows thereto will normally be sufficient to free the connection at the frusto-conical interface so that the useless drill bit 10 and coupling 40 merely fall free, most usually without any damage to the extension bar 20A. Even if the frusto-conical surface of socket 22A does become heat damaged, it is normally not sufficient to prevent re-use of the extension bar 20A. If coupling 40 is not welded to drill bit 10, or otherwise damaged, it can be removed from the used drill bit and re-used again in another tap. On the other hand, if the coupling is damaged or welded to the drill bit, it can be discarded with the drill bit with the knowledge that the more expensive extension bar was saved from that fate.

Figure 3:
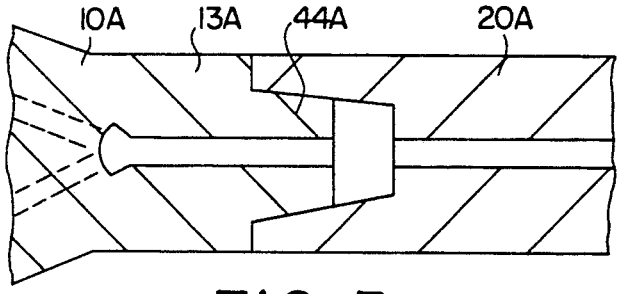
FIG. 3 is another cross sectional side view illustrating a connection between a modified drill bit and extension bar according to another embodiment of this invention, wherein the coupling is incorporated into the drill bit so that a separate coupling device is not utilized.

While the above described embodiment utilized a conventional drill bit, as is readily available from several commercial sources, reference to FIG. 3 will illustrate another embodiment of this invention wherein a unique new drill bit is utilized which is provided with a frusto-conical extension as an integral portion thereof so that a coupling is not needed. As shown in FIG. 3, drill bit 10A is not provided with a pilot hole in the shank thereof, but rather has a solid shank 13A having a frusto-conical extension 44A extending therefrom. In this embodiment, therefore, the drill bit and coupling are manufactured as a single piece. The one disadvantage of this embodiment is that there is no coupling which can be salvaged, and therefore, the entire drill bit structure must be discarded after each tap. On the other hand, the drill bit 10A may be cheaper to produce because the pilot hole will not have to be machined to effect the screw threads, and the frusto-conical extension 44A can be utilized in an as-cast form, or with only a modest grinding thereof if the as cast form is not as smooth as desired. Furthermore, since a pilot hole is not necessary, a major portion of the shank can be eliminated, so that the overall modified drill bit 10A will be cheaper to produce than a conventional drill bit. Such a "shankless" drill bit 10B is illustrated in the embodiment depicted in FIG. 4.

Figure 4:
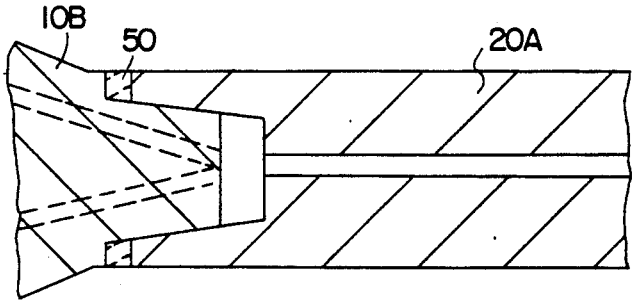
FIG. 4 is another cross-sectional side view illustrating a modified version of the embodiment shown in FIG. 3, utilizing a ceramic washer at the outer interface.

To greatly minimize the probability for the drill bit to become welded to the coupling 40 or to the extension bar in the embodiment depicted in FIG. 3, a ceramic protected coupling can be utilized, such as a ceramic washer or sleeve as disclosed in co-pending patent application Ser. No. 504,440. Further reference to FIG. 4 will illustrate such a ceramic washer 50, which is disposed at the exposed periphery of the junction between drill bit 10B and extension bar 20A. As disclosed in that co-pending application, such a washer or sleeve which spaces one component of the drill rod assembly from another at the exposed outer periphery, will serve to greatly minimize the probability for the components to become welded together. In the application as depicted in FIG. 4, washer 50 is preferably a steel washer having a flame sprayed ceramic coating, preferably zirconia, titania or the like.

In a like manner the flange portion 42 of coupling 40 can be provided with a flame sprayed ceramic coating. Such a ceramic coated flange will function in substantially the same way as a ceramic coated steel washer to greatly minimize the probability that the drill rod components on each side of the coated flange will become welded together, as disclosed in the above noted co-pending patent application.

Figure 5:
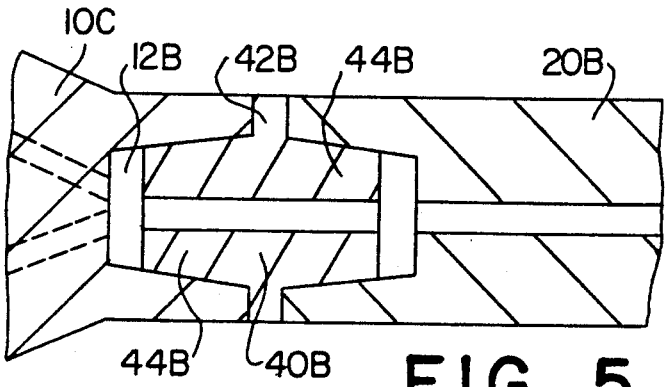
FIG. 5 is a further cross-sectional side view illustrating another embodiment of this invention wherein a tapered connection is provided at both the extension rod and drill bit connections.
Figure 6:
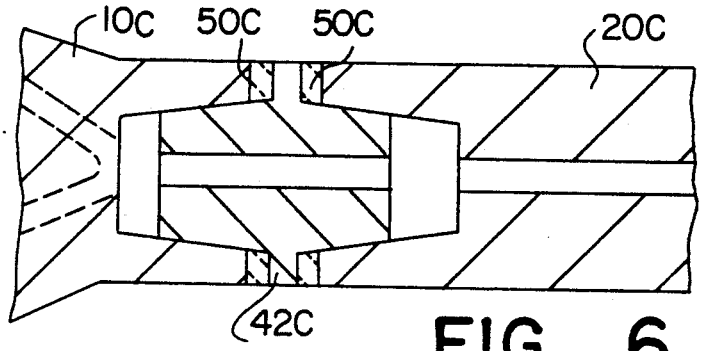
FIG. 6 is still another cross sectional side view similar to that shown in FIG. 5 except that ceramic washers are incorporated between the two interfaces.

As an alternative to the above described modified drill bit, this invention further contemplates the use of a tapered frusto-conical connection between the coupling and the drill bit as well as the extension bar. As shown in FIG. 5, the drill bit 10C in this embodiment is not provided with a screw threaded pilot hole, but rather a pilot hole 12B having a tapered frusto-conical surface. Accordingly, coupling 40B will have a frusto-conical extension 44B on each side of flange 42B. According to this embodiment therefore, he drill bit 10C is attached to coupling 40B the same way that extension bar 20B is attached, so that both components are provided with a quick connect and disconnect feature, and screw threaded connections are completely avoided. As previously described, such a frusto-conical friction connection will be less susceptible to damage, so that the average life of such a coupling can be even further increased. Here again, since it is not necessary to machine screw threads into the pilot hole on the drill bit 10C, the cost of producing such a drill bit 10C will be reduced, and in addition, the coupling 40B will be more likely to be salvageable. Reference to FIG. 6 will illustrate essentially the same embodiment except the ceramic washers 50C are provided on both sides of flange 42C for the beneficial reasons as previously noted.

Figure 7:
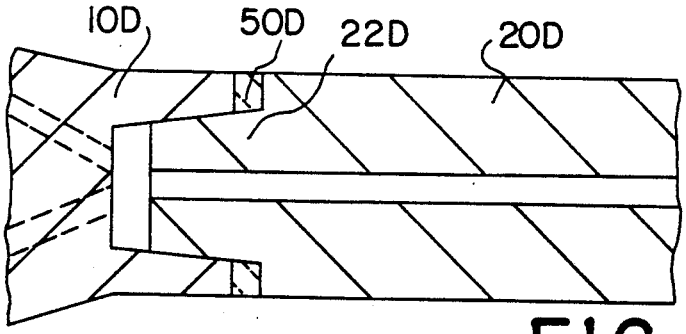
FIG. 7 is another cross-sectional side view illustrating another embodiment of this invention wherein the extension bar is fitted into the drill bit without a coupling.

Reference to FIG. 7 will illustrate still another embodiment of this invention wherein the drill rod extension bar 20D is provided with a frusto-conical extension 22D, to mate with the frusto-conical socket 12B in drill bit 10C. As shown, the particular embodiment illustrated utilizes the optional ceramic washer 50, and therefore, is merely the reverse connection of that shown in FIG. 4.

Figure 8:
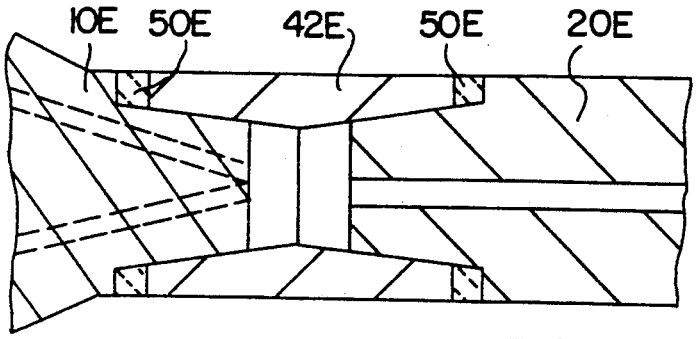

Reference to FIG. 8 will illustrate one more embodiment of this invention wherein the drill bit 10E and the extension bar 20E are both provided with a frusto-conical extension and are coupled together with a sleeve-like coupling 42E having a frusto-conical socket in each end. Here again the illustrated embodiment utilizes optional ceramic washers 50E at each outside interface between the coupling 42E and the drill bit 10E and extension bar 20E. As should be apparent from the above embodiments, any combination of mating frusto-conical extensions and sockets can be utilized.

While all of the above inventive couplings have been shown and described in connection with attaching a drill bit to a extension bar, it should be appreciated that any of these techniques can be utilized as well to join the extension bar to the drill rod, with comparable results. The use of such a frusto-conical friction fit connection would be particularly advantageous in coupling an extension bar to a drill rod, as compared to the use of a conventional tubular coupling 31 as depicted in FIG. 1. Not only is it time consuming to screw fasten the components as shown in FIG. 1, but the increased diameter presented by the coupling 31 in FIG. 1 is particularly susceptible to attack by the molten hot metal, which is often concentrated at the extension bar-coupling interface aligned with the periphery of the extension bar.

In view of the several embodiments and variations of this invention as described above, it should be apparent that numerous other embodiments, variations and modifications could be incorporated without departing from the spirit of the invention. In addition, practically any two or more of the above described embodiments can be combined to protect different interfaces on a drill rod assembly.

What is claimed is:

1. A blast furnace tap hole drill having an elongated drill rod assembly comprising a plurality of component parts coupled together, said component parts including at least a drill bit and a drill rod, at least two of said component parts coupled together by a quick connect-disconnect coupling wherein a first of said two component parts has an extension thereon having frusto-conical side walls adapted to be inserted into and mate with a socket having frusto-conical side walls within the second of said two component parts, said frusto-conical side walls having an angle sufficient to permit said frusto-conical side walls of said extension to frictionally engage and be tightly fastened to said frusto-conical side walls of said socket.

2. A blast furnace tap hole drill according to claim 1 in which said angle is from 3 to 12 degrees.

3. A blast furnace tap hole drill according to claim 1 in which a body portion is interposed between the two said means.

4. A blast furnace tap hole drill according to claim 3 in which said body portion comprises a flange.

5. A blast furnace tap hole drill according to claim 4 in which said flange is provided with a ceramic coating.

6. A blast furnace tap hole drill according to claim 1 in which said first component part is a drill rod extension bar and said second component is a drill bit.

7. A blast furnace tap hole drill according to claim 1 in which said first component part is a drill bit and said second component is a drill rod extension bar.

8. A blast furnace tap hole drill according to claim 1 in which said first component parts is a coupling secured to a third component part.

9. A blast furnace tap hole drill according to claim 1 in which a ceramic washer is interposed between said two component parts encircling said frusto-conical extension.

10. A blast furnace tap hole drill according to claim 1 in which said extension having frusto-conical side walls is incorporated into a coupling device separable from both adjoining component parts of said drill rod assembly.

11. A coupling device for a drill rod assembly on a blast furnace tap hole drill comprising a body portion, having a first means for connecting said coupling to a first drill rod component, and a second means opposite said first means for connecting said coupling to a second component of said drill rod, at least one of said means consisting of an extension having frusto-conical side walls adapted to mate with a socket having frusto-conical side walls within the drill rod component to be connected thereto, said frusto-conical side walls having an angle sufficient to frictionally engage and tightly fasten said drill rod component onto said coupling.

12. A coupling according to claim 11 in which said angle is from 3 to 12 degrees.

13. A coupling according to claim 11 in which a body portion is interposed between the two said means.

14. A coupling according to claim 13 in which said body portion comprises a flange.

15. A coupling according to claim 14 in which said flange is provided with a ceramic coating.

16. A coupling according to claim 11 in which said first means comprised a screw threaded head portion adapted to be secured into a screw threaded socket of a drill bit, and said second means comprising said frusto-conical extension is adapted to mate with a frusto conical socket in an extension bar.

17. A coupling according to claim 11 in which said first means comprised a screw threaded head portion adapted to be secured into a screw threaded socket of an extension bar, and said second means comprising said frusto-conical extension is adapted to mate with a frusto-conical socket in a drill bit.

18. A coupling according to claim 11 in which both of said means consist of an extension having frusto-conical side walls each adapted to mate with a socket having frusto-conical side walls within the drill rod component to be connected thereto.

19. A blast furnace tap hole drill having a drill rod assembly comprising drill rod components including a drill rod, an extension bar, a drill bit and a drill bit coupling, said drill bit coupling comprising a body portion, having a first means for connecting said coupling to said drill bit, and a second means opposite said first means for connecting said coupling to said extension bar, at least one of said means consisting of an extension having frusto-conical side walls adapted to mate with a socket having frusto-conical side walls within the drill rod component to be connected thereto, said frusto-conical side walls having an angle of from 3 to 12 degrees as sufficient to frictionally engage and tightly fasten said drill rod component onto said coupling.

20. A coupling according to claim 19 in which a ceramic coated flange portion of said coupling is interposed between the drill bit and said extension bar.

21. A coupling device for a blast furnace tap hole drill rod assembly for effecting a quick connect-disconnect coupling of adjoining component parts of said assembly, said coupling device comprising a first connecting means for connecting said coupling device to a first drill rod component to effect a first inter-connection, a second connecting means opposite said first connecting means for connecting said coupling device to a second drill rod component to effect a second inter-connection, and a body portion comprising a flange spacing said first and second connecting means, at least one of said inter-connections being a frusto-conical friction connection whereby an extension having frusto-conical side walls, said frusto-conical side walls having an angle sufficient to frictionally engage and tightly fasten said drill rod component onto said coupling device.

22. A coupling device according to claim 20 in which said angle is from 3 to 12 degrees.

23. A coupling device according to claim 20 in which said flange is provided with a ceramic coating.

24. A coupling device according to claim 20 in which said first coupling means comprises a screw threaded head portion adapted to be secured into a screw threaded socket of a drill bit, and said second coupling means comprising said frusto-conical extension is adapted to mate with a frusto-conical socket in an extension bar.

25. A coupling device according to claim 20 in which said first coupling means comprises a screw threaded head portion adapted to be secured into a screw threaded socket of an extension bar, and said second connecting means comprising said frusto-conical extension is adapted to mate with a frusto-conical socket in a drill bit.

26. A coupling device according to claim 20 in which both of said connecting means consist of an extension having frusto-conical side walls each adapted to mate with a socket having frusto-conical side walls within the drill rod component to be connected thereto.

* * * * *